US007912631B2

(12) United States Patent
Howard et al.

(10) Patent No.: US 7,912,631 B2
(45) Date of Patent: Mar. 22, 2011

(54) SYSTEM AND METHOD FOR DISTRIBUTED ENGAGEMENT

(75) Inventors: Michael Howard, Westlake Village, CA (US); David Payton, Calabasas, CA (US)

(73) Assignee: Raytheon Company, Waltham, MA (US)

( * ) Notice: Subject to any disclaimer, the term of this patent is extended or adjusted under 35 U.S.C. 154(b) by 1356 days.

(21) Appl. No.: 11/336,145

(22) Filed: Jan. 19, 2006

(65) Prior Publication Data

US 2007/0168117 A1 Jul. 19, 2007

(51) Int. Cl.
*G01C 21/00* (2006.01)

(52) U.S. Cl. ..... 701/207

(58) Field of Classification Search ..... 701/200, 701/207; 244/3.1, 1.11, 3.15
See application file for complete search history.

(56) References Cited

U.S. PATENT DOCUMENTS

| | | | | |
|---|---|---|---|---|
| 5,712,441 | A | 1/1998 | Grunewald | |
| 7,137,588 | B2 * | 11/2006 | Humphrey | 244/3.15 |
| 2004/0030449 | A1 * | 2/2004 | Solomon | 700/245 |
| 2006/0015215 | A1 | 1/2006 | Howard et al. | |

OTHER PUBLICATIONS

Reid G. Smith, "The Contract Net Protocol: High-Level Communication and Control in a Distributed Problem Solver," IEEE Transactions on Computers, vol. C-29, No. 12, Dec. 1980, pp. 1104-1113.
Modi et al, "An Asynchronous Complete Method for Distributed Constraint Optimization," Proceedings of Autonomous Agents and Multi-Agent Systems, 2003, http://teamcore.usc.edu/papers/2003/modi-aamas03.pdf.

* cited by examiner

*Primary Examiner* — Yonel Beaulieu
(74) *Attorney, Agent, or Firm* — The Noblitt Group, PLLC

(57) ABSTRACT

The disclosed system for cooperative engagement generally includes a control system in communication with an actuation system, an effector system, a sensor system and a communications interface. Disclosed features and specifications may be variously controlled, adapted or otherwise optionally modified to realize improved distributed designation and/or engagement function. Exemplary embodiments of the present invention generally provide cooperative designation and engagement of targets for air-, land-, sea- or space-based weapon systems.

21 Claims, 4 Drawing Sheets

SYSTEM AND METHOD FOR DISTRIBUTED ENGAGEMENT

FIELD OF INVENTION

The present invention generally concerns systems and methods for coordinating engagement of targets; and more particularly, representative and exemplary embodiments of the present invention generally relate to distributed coordination of one or more autonomous or semi-autonomous agents for the engagement of one or more targets.

REFERENCE TO COMPUTER PROGRAM LISTING APPENDIX

Included with the present invention is a computer program listing appendix submitted on two compact discs, consisting of one original compact disc and one exact replica compact disc. The data on each disc includes a representative sample of computer simulation code. The computer code is represented on the compact disc under the file name "RAYTH.2300_2010-01-27_Computer Program Listing Appendix.pdf" which was created on Jan. 27, 2010 and comprises 34 kilobytes. All of the material contained on the compact discs are herein incorporated by reference.

BACKGROUND OF INVENTION

Today, many unmanned vehicles include control systems that allow them to perform autonomous or semi-autonomous tasks. Some of these vehicles are able to gather information regarding their environment, potential threats and potential targets to make decisions and control the actions of the vehicle. Additionally, many manned vehicles include control systems that perform functions with little or no direction from the pilot.

In circumstances where multiple systems, each having a measure of autonomous control, must be coordinated to work together, a number of issues may arise. For example, one conventional model is to give a single entity centralized control, such as in the case of a ship launching missiles. The ship processes information on potential targets and assigns targets to the missiles. However, this system has substantial drawbacks. First, since all missiles are controlled from a single source, the destruction of the centralized source generally results in a loss of ability for the missiles to engage their target(s). Second, in order to adequately direct missiles to targets, the centralized source must typically collect and maintain data on both the missiles and the potential targets, which may be impractical or otherwise time consuming in certain applications. Finally, a centralized control system may be inappropriate in situations where the central hub is too far displaced to adequately direct the controlled vehicles.

One solution to the issues arising from the centralized control of autonomous or semi-autonomous agents in cooperative engagement of targets is to distribute the control to the agents. That is, the agents themselves negotiate and determine which targets they will engage. Such a system helps to eliminate some of the problems associated with controlling the agents from a central source; however, this type of distributive control presents a number of problems. One of the problems facing distributive control is the management of which agents will be assigned to various targets. For example, an "auction" scheme of control, where various agents submit bids to a central "auctioneer" to determine which one should be assigned the target, presents the same bottleneck problem as that of the centralized control system discussed vide supra.

Furthermore, in such an auctioning system, the amount of information that must be transferred between the agents and negotiation of bids that must occur generally will be impractical or otherwise burdensome in many situations.

SUMMARY OF THE INVENTION

In various representative aspects, the present invention provides systems, devices and methods for the cooperative engagement of targets with autonomous agents. Exemplary features generally include a control system in communication with an actuation system, an effector system, a sensor system and a communication interface.

Advantages of the present invention will be set forth in the Detailed Description which follows and may be apparent from the Detailed Description or may be learned by practice of exemplary embodiments of the invention. Still other advantages of the invention may be realized by means of any of the instrumentalities, methods or combinations particularly pointed out in the claims.

BRIEF DESCRIPTION OF THE DRAWINGS

Representative elements, operational features, applications and/or advantages of the present invention reside inter alia in the details of construction and operation as more fully hereafter depicted, described and claimed—reference being made to the accompanying drawings forming a part hereof, wherein like numerals refer to like parts throughout. Other elements, operational features, applications and/or advantages will become apparent in light of certain exemplary embodiments recited in the detailed description, wherein:

FIG. 1 representatively illustrates a subsumption diagram of a cooperative engagement system, in accordance with an exemplary embodiment of the present invention, wherein the upper input of each subsumption operator (S) takes precedence over the lower input (where applicable), and the lower input of the inhibition operator (I) controls whether the signal from the upper input is allowed to pass through;

Figure 1:
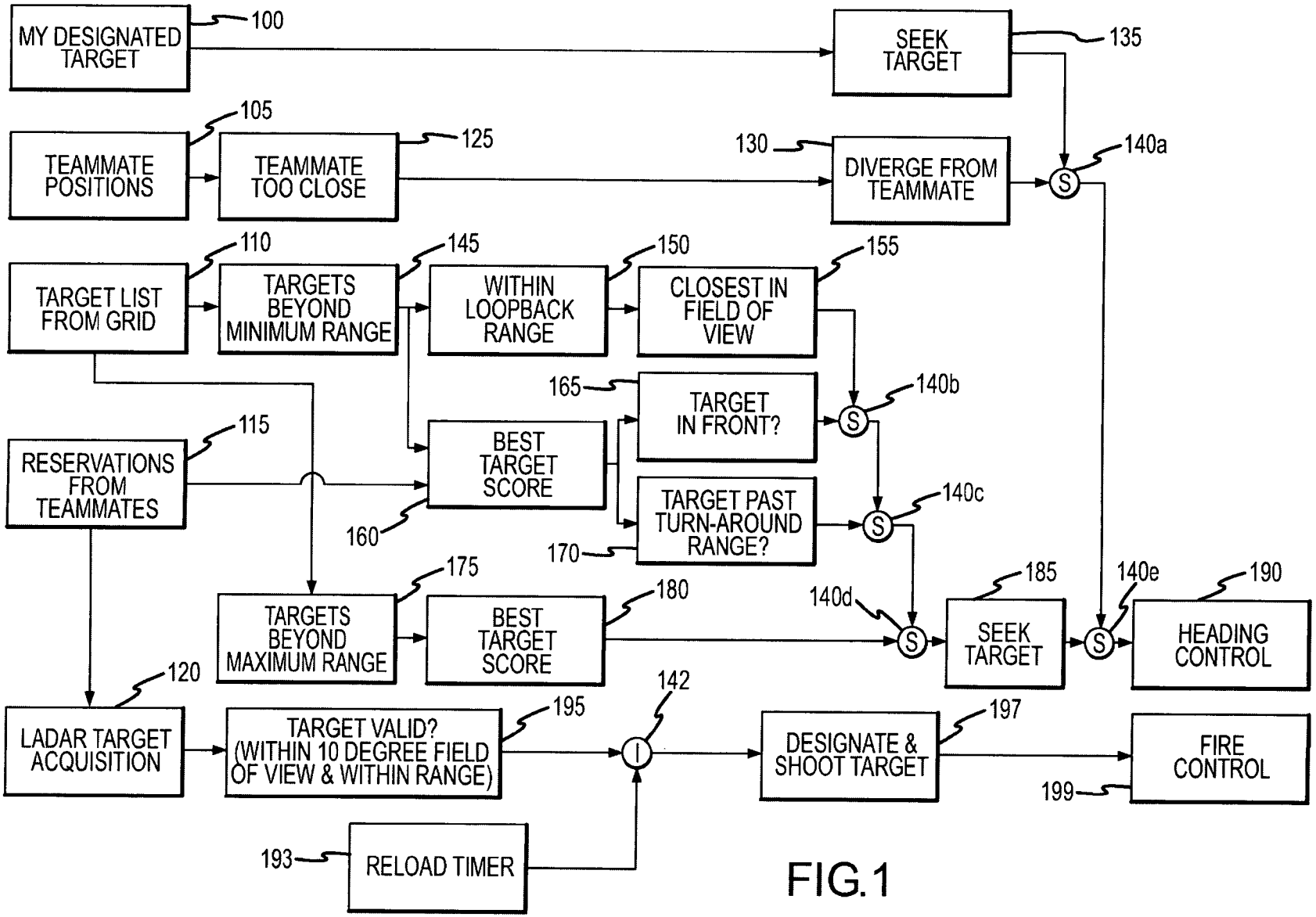

Elements in the Figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms "first", "second" and the like herein, if any, are used inter alia for distinguishing between similar elements and not necessarily for describing a sequential or chronological order. Moreover, the terms "front", "back", "top", "bottom", "over", "under", "forward", "aft" and the like in the Description and/or in the claims, if any, are generally employed for descriptive purposes and not necessarily for comprehensively describing exclusive relative position. Any of the preceding terms so used may be interchanged under appropriate circumstances such that various embodiments of the invention described herein, for example, may be capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventors' conception of the best mode, and are not intended to limit the applicability or configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

In conventional systems, missiles and other autonomous vehicles do not collaboratively engage targets. Individual missiles are generally fired at individual targets, although it is more common now for missiles to have onboard intelligence and to search locally for their targets once they reach a given location. A centralized weapon-target pairing optimization algorithm would be useful to assign targets to agents. It could be argued that if agents submit themselves to such a central algorithm, they are collaborating; however, such an algorithm must have information about the capabilities and locations of each agent, as well as the type and locations of each target in order to make an optimal assignment. Collecting and maintaining that information may be impractical and the optimization can take time.

A more appropriate comparison of the present invention may be made with conventional algorithms that do not require that detailed information about each agent be continuously communicated to a central location. The most common of these enables the agents to negotiate among themselves using economic metaphors such as auctioning the shooting tasks. But those methods generally require that all agents use the same negotiation protocol and that they be able to communicate bid values based on mutually agreed upon metrics (thus are comparable). In a coalition scenario, with more than one country firing at targets in the same theater, this may be impractical. Even among joint forces of a single country, it may be difficult to ensure that much compatibility. The present invention discloses a method that employs a minimal amount of coordination: announcing which target an agent will engage next (e.g., making a "reservation").

Conventional economic methods typically require a central auctioneer to announce tasks, to collect bids from bidders and to announce the winners of each task auction. The auctioneer process may be located on one of the agents, but choice of auctioneer is another issue in a dynamic situation with rapidly changing sets of agents, possibly from different coalition partners. The auctioneer may be located at theater headquarters, but the farther away the auctioneer is from the targets, the longer the communication takes and the more likelihood of jamming. The auctioneer might be located on a node in the NetCentric Grid closest to the location of the targets, but one is still left with the issue of requiring each agent to have comparable target rating systems and obeying the same negotiation protocol. The present invention does not require an auctioneer.

A significant difference between the present invention and an auction method concerns communications requirements. When the present invention has a missile declare a reservation on a particular target, the system could just as easily broadcast a sorted list of all its target scores and it then could shoot the top target on its list that nobody else scores higher. But that would generally require a second round of communication to announce the target it wants to reserve, and maybe a third round if someone else who did have a higher score for one of your top targets decides to shoot something else. A distributed constraint satisfaction algorithm that imposed a hierarchical priority tree on the agents to break these kinds of ties was tested, but the system generally requires a tremendous amount of communication to come to a consensus. The present invention proposes only that each agent broadcast the identity of its selected target whenever it chooses a new one.

If the agents have knowledge of the capabilities and positions of the other agents, the present invention can improve performance by predicting the choices the other agents will make. Each agent can then attempt to maximize a global cost metric. In the extreme, if every agent were to have perfect knowledge of the other agents and the location and type of target(s), an optimal auction without any negotiation could result; however, practically speaking, in joint forces or coalition operations, such perfect knowledge is not generally feasible.

The present invention is generally simpler than market-based approaches since the greedy and the tactical coordination components do not require as much communication. Since the basic algorithm does not require that the agent maintain any state on the number or type of other agents, the disclosed system is generally unaffected if any other agent is shot down, or if new agents are added to the scenario. So, for example, if the commander fires two missiles (with submunitions) at a large number of targets, and they are not able to take out the targets fast enough, extra missiles can be fired. The system will adapt automatically to include the new missiles in the hunting group. Additionally, the disclosed system chooses one target at a time, so it generally does not matter if any other targets are killed in the interim between choosing and killing a target.

An exemplary embodiment of the present invention provides a system and method for a plurality of weapon agents to cooperatively coordinate approach and engagement of a plurality of targets. An agent may be an autonomous mobile agent (e.g., land-, sea-, air- or space-based), which has the capability to destroy at least one target. Examples of suitably configured agents include inter alia: missiles with onboard guidance systems adapted to perform local searches for a target and explode on impact; unmanned vehicles with integrated weapons systems that can fire multiple submunitions; and/or the like. The disclosed exemplary method utilizes distributed data processing with very low computational complexity, and hence is suitable for running aboard each agent weapon device. There is no need for centralized control systems, which typically demonstrate substantial communication latencies as well as susceptibility to electronic jamming. In such a representative embodiment, the present invention may be alternatively described as a method for distributed dynamic weapon-target pairing.

The present invention provides a high-level control system for onboard control of an autonomous vehicle, given a set of locations of potential targets. By "high-level," we mean that the system provides navigation signals and weapon firing controls, but assumes that the system is working in conjunction with a low-level control system that performs path deconfliction for flying in a crowded airspace, for example, to avoid terrain obstacles and to avoid dynamic obstacles such as enemy surveillance and weapons systems.

The present invention comprises a basic greedy behavior-based system in addition to a tactical component. The greedy algorithm may not generally be characterized as cooperative, inasmuch as the greedy algorithm goes after the closest target that is not currently being fired at by any other agent. But there is no guarantee that two agents won't go after the same target—whoever gets there first may shoot and the other agent must find another target. Accordingly, the greedy algorithm is not optimal, but it is robust and simple.

A tactical component adds cooperation on top of the greedy sub-system by making early choices among the targets and letting the other agents know these choices (e.g., "reservations"). The tactical component rates each potential target based on criteria that include inter alia avoiding targets that have been reserved by other agents and preferring targets that pose an imminent threat to protected assets. It is conceivable that any function that provides a ranking over all potential targets may be substituted for the tactical component. The present invention provides at least one simple implementation of the tactical component as a combination of a set of metrics reduced to a normalized score for each target. This method generally chooses one target at a time. A more sophisticated tactical component might look ahead more than one engagement, trying to set up the next engagement in similar fashion to the way a billiards player lines up shots.

Electronic market metaphors, such as auctions, may be used to achieve a similar goal; however, the disclosed technique can operate in coalition and joint force operations where auctions are generally not practical. This is because the disclosed system and method has only one requirement for coordination—e.g., each agent should be able to tell every other agent which target it will engage next. There are no negotiations, so it is not required that every agent 'know' the same negotiation protocols or have comparable target valuation metrics. There is no need for a central arbiter to award tasks. The calculations, in accordance with various representative and exemplary embodiments of the present invention, are simple, fast and robust.

The present invention is not limited to the agent-killer domain described vide supra. More generically, the disclosed system applies to teams of mobile agents that have effectors with limited range and that perform tasks that are geographically located. For example, a team of agents on Mars might be tasked to take soil samples in dozens of disparate areas. Some areas might seem more important at the start of the mission, but as samples are taken the priorities could dynamically change. Waiting for communication round-trip to Earth would waste time. Keeping in mind that the invention has more general applications, in this disclosure we will continue to speak mainly in terms of military agent-killer domains.

The present invention is a new distributed allocation technique that may be used in conjunction with a simulation to provide an offline decision support system that can advise a commander how many weapons to fire (or alternatively, how may agents to deploy to affect a particular goal), as well as an onboard high-level component for a control system on, for example, an autonomous vehicle. The present invention may be adapted to perform distributed weapon-target pairing for a team of agents cooperatively shooting targets, as well as other uses, such distributed task allocation for agents with effectors cooperatively performing tasks.

The disclosed invention employs a hybrid of a greedy behavioral approach with a tactical component. The greedy behavior-based component is relatively simple to implement, is robust in dynamic situations, and requires little coordination. In the greedy approach, each agent goes for the closest target that is not currently being engaged by another agent.

Layered on top of the greedy component is a tactical component that performs a minimal amount of coordination by making target reservations. That is to say, when an agent needs to decide the next target to pursue, it does an early selection and announces it to the other agents. The selection process may comprise a weighted combination of several criteria reduced to a composite score. It will be appreciated, however, that they are many different ways that a substantially similar result may be achieved.

As representatively illustrated in FIG. 1, an architectural view of an implementation of the invention comprises a control system providing heading and fire control signals for one member of a team of agents. In this diagram, subsumption operators S 140*a*, 140*b*, 140*c*, 140*d*, 140*e* give their upper input precedence over their lower input, provided that the upper input is valid. Input data may be found in the boxes along the left side: the agent's current designated target 100, teammate positions 105, list of targets from grid 110, teammate reservations 115, and LADAR target acquisition data 120. Output data may be found in the boxes at the extreme right side: heading control 190 and fire control 199. Data processing and agent behaviors are processed between the inputs at the left and the outputs at the right: determination if teammates are too close 125; determination of the subset of targets beyond the minimum range 145; determination of the subset of targets beyond the maximum range 175; determination if the target is valid/within field of view 195; determination of the subset of targets from 145 that are within loop-back range 150; determination of the target from 145, 175 with the best target score 160, 180; determination of the target from 150 that is the closest in the field of view 155; determination if the target is 'in front' 165; determination if the target is past the turn-around range 170; seeking the target 135, 185; diverging from teammates 130; designating and shooting the target 197. It is assumed that each agent gets updates on the locations of a list of targets from "the Grid." The Grid is a euphemism for a set of cooperative battlespace sensing and communication nodes (sometimes called "the global information grid") that are part of what is known as Network Centric Warfare. Although we don't deal with Network Centric Warfare directly in this disclosure, there is likely to be some uncertainty in the positions of targets communicated to the agents. Inhibition operation (I) 142 operates to delay the designate and shoot operation 197 to allow sufficient time after shooting to reload and prepare another weapon for launch.

The behavior-based control system representatively illustrated in FIG. 1 provides heading and fire control signals to control at least one member of a team of agents tasked with hunting and shooting groups of targets. The tactical components are generally given as elements 115 (teammate reservations) and 160, 180 (maximization of the target score). Purely greedy components would head for the closest target instead.

Agents obtain updates on the locations of other agents in the team and have onboard sensors that are capable of performing target acquisition when the agents are in range. When an agent decides which target it intends to engage next, it "reserves" the target by announcing the reservation to the other agents. Finally, the input on the upper left, 'My Designated Target' 100, is typically internal to the agent. In the particular embodiment depicted in FIG. 1, agents may have laser designators 120 and submunitions that home in on a designated target 135. In the subsumption diagram, since the seeking 135 of the designated target is the highest level input to the highest subsumption operator 140*a*, this indicates that the highest priority for an agent is to continue heading toward a target it is currently designating.

Figure 2:
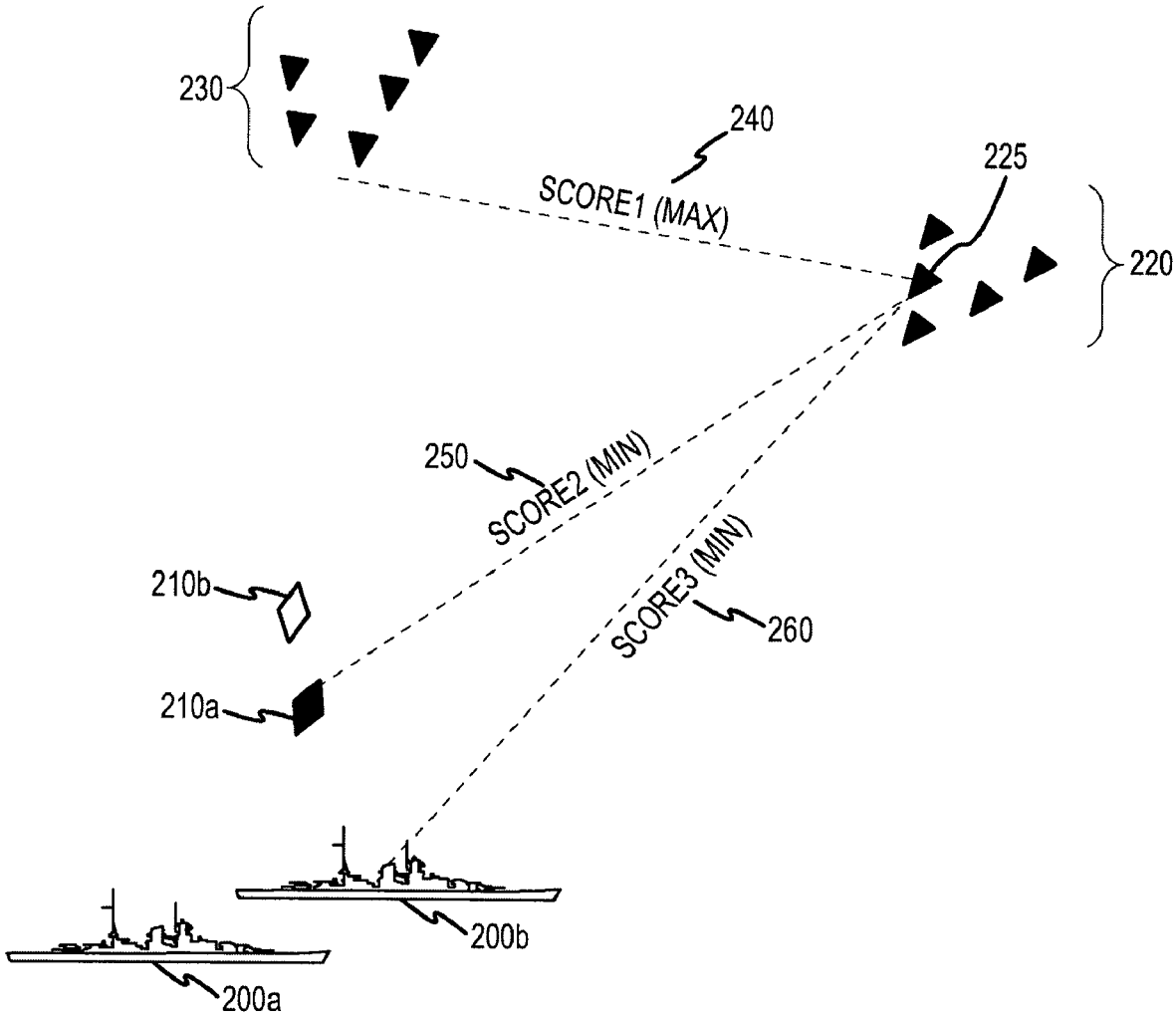
FIG. 2, representatively illustrates the distances used in a scoring function for implementation of a method for distributed engagement in accordance with an exemplary embodiment of the present invention.

FIG. 2 representatively illustrates inter alia the distances used in the scoring function to compute the value of target 225. These distances may be used to implement an exemplary embodiment of the disclosed distributed engagement system. The scoring function is used to evaluate each target (for example, 225). Of course, the choice of components for the scoring function may be designed appropriately for each particular domain and specific application. Score 1 (240) represents the maximized distance between a target 225 in a first enemy target swarm 220 and the closest reserved enemy target. Score 2 (250) represents the minimized distance between an engagement agent 210*a* and a target 225. Score 3 (260) represents the minimized distance between a target 225 and any protected asset 200*a*, 200*b*. Each component may be normalized, scores to be minimized may be inverted, and then the scores may be combined using, for example, a weighted sum.

Targets that are reserved by other teammates are filtered out of the target list and the rest of the targets are submitted to a range test. Representative details of such a process are illustrated in the sample simulation code disclosed vide infra, but essentially, any of those targets that are beyond the minimum range are scored and the best target is selected. The scoring function is discussed below. The agent announces its 'best target selection' 160 to the other agents and heads toward it. In the agent-killer scenario, it is possible to adjust the scoring function to select targets that draw the agents 210*a*, 210*b* toward different areas of the target swarms 220, 230. But once the agent gets in range of the selected target, the fire control system is free to choose any valid target. Alternatively, conjunctively or sequentially, the fire control system may be configured to shoot at the selected target.

Note that fire control 199 operates substantially independently of agent motion control. The fire control system 199 designates a target and fires the weapon at it whenever a valid target is in range. It is heading control's 190 function to get the weapon in range, and once fire control 199 designates a target, the top priority for heading control 190 is to keep heading toward that target. This is represented in the highest level of the diagram generally depicted in FIG. 1. If there is no designated target, keeping at least a minimum distance away from teammates (diverging) takes precedence over seeking a target. But once the vehicle is away from teammates, the agent will seek a target.

Turn-around range may be tested after an agent with multiple submunitions has made a pass over a group of targets, for example, to prevent the agent from turning back too soon. This behavior is controlled by the variables turn-around range and loopback range. Targets behind the agent must be beyond turnaround range before the agent will turn to get them. Targets within loopback range that are in front of the agent take precedence over targets behind the agent.

In the case of heterogeneous agents, the disclosed system may be configured to add to the tactical scoring system a preference for the targets that the system's unique capabilities are most suited for, or conversely, that teammates are not as well suited for.

As mentioned vide supra the tactical component of an exemplary embodiment of the present invention may be layered on top of a greedy behavior-based control system. In a purely greedy system each agent would head for the closest target, or one that otherwise provides the most value for the least amount of work according to a local utility function. But in the disclosed system, a "Best Target Score" function 160 replaces the greedy 'closest target' function.

The target scoring function may be constructed to cause individual agents to approximate a global utility metric in their choice of targets. In the agent-killer exemplary embodiment disclosed herein, each agent selects its next target by scoring each target using, for example, the distances illustrated in FIG. 2.

Figure 3:
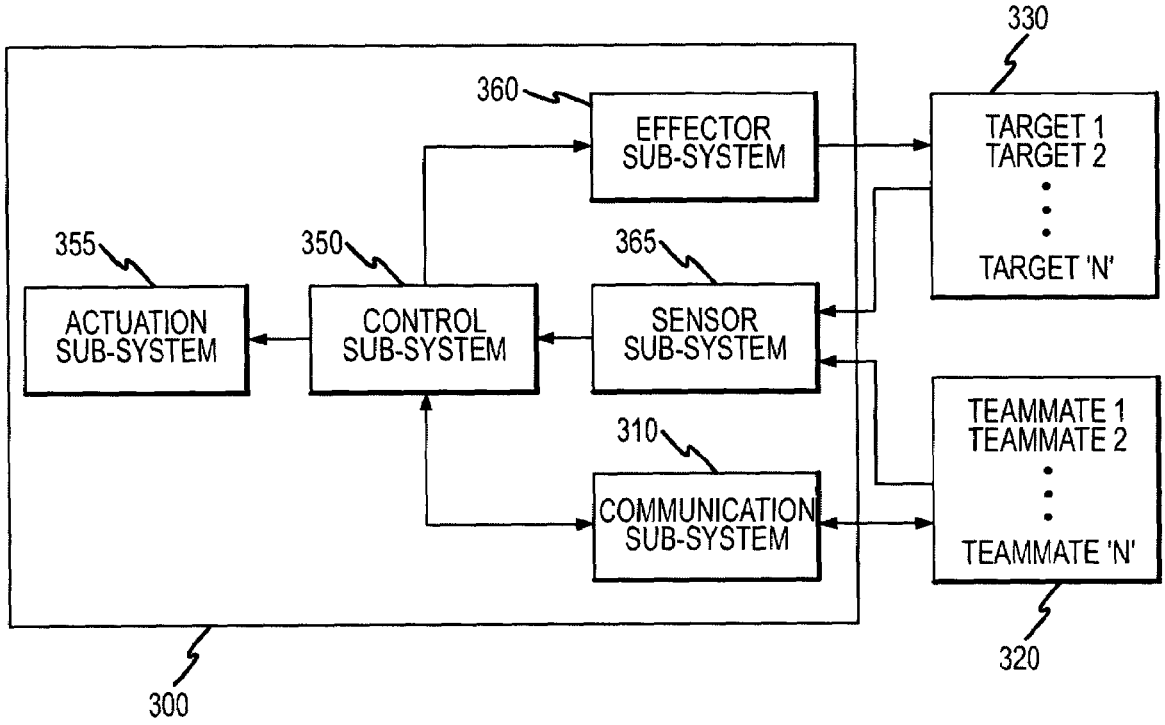
FIG. 3, representatively illustrates a block diagram of a cooperative engagement system in accordance with an exemplary embodiment of the present invention.

Various representative implementations of the present invention may be applied to any system for cooperative engagement. In one exemplary embodiment, in accordance with various aspects of the present invention, referring now to FIG. 3, a system 300 for cooperative engagement may be configured to include a control system 350 in communication with each of the following: an actuation system 355; an effector system 360; a sensor system 365; and a communication interface 310. In the disclosed exemplary embodiment, control system 350 receives information on targets 330 and teammates 320 via sensor sub-system 365. Control system 350 selects a target from target pool 330 to affect and reserves the target by communicating the target's identity via communications sub-system 310. Actuation system 355 is responsive to control system 350 and suitably moves the cooperative engagement agent so that the target may be acted upon by effector sub-system 360. It should be appreciated that the system for distributed cooperative engagement 300 may be implemented in any other suitable manner, such as providing virtual representations of the cooperative engagement system 300 and the effector target on a computer screen and controlling their behavior via a computer program running on a computer system.

Control system 350 may be implemented in any suitable manner, such as a computer program running on a computer system, a system-on-a-chip and/or the like. Control system 350 may interface with any number of sub-systems and/or devices to achieve a substantially similar result to the representative embodiments disclosed herein. In the disclosed exemplary embodiment, for example, control system 350 may be suitably configured to receive data concerning targets 330 from sensor sub-system 365. Control system 350 may be further adapted to select a target from target pool 330 to affect, actuate the cooperative engagement system 300 via the actuation sub-system 355, affect the target via effector sub-system 360, and communicate target reservations via communications interface 310.

Control system 350 may perform any function and process substantially autonomously and/or automatically, or may alternatively, conjunctively or sequentially receive control commands from any suitable source. For example, in an exemplary embodiment according to various aspects of the present invention, a system for cooperative engagement may comprise a land mine disposal agent wherein the control system receives control signals from a remote operator via a communications interface.

Actuation system 355 may be implemented in any suitable manner to achieve a substantially similar result in accordance with exemplary embodiments disclosed herein. For example, actuation system 355 on an airborne cooperative engagement system may comprise a propeller, an electric engine, wings, ailerons and/or any other suitable systems and devices to allow the cooperative engagement system to move through the air. Actuation sub-system 355 may include any number of sub-systems and devices to achieve any purpose to permit a cooperative engagement agent to move in any number of different environments. For example, actuation system 355 may be suitably adapted to allow an agent to alternatively move on land, in the air, and/or above and below the surface of a body of water.

Effector sub-system 360 may be suitably adapted to affect a target in any suitable manner for any specific purpose. For example, effector system 360 may comprise an anti-aircraft missile mounted on an airborne cooperative engagement system to affect a target that is an aircraft. In another exemplary embodiment, an effector system 360 used to detect and disarm land mines may comprise multiple devices, such as agentic arms, electric tools, and/or the like. Effector system 360 may also include any number of sub-systems making up the cooperative engagement system. For example, a suitably adapted cooperative engagement system may comprise a missile wherein the effector system 360 includes an explosive warhead, which affects a target by ramming the target and exploding.

In addition to affecting the target in a physical manner, the effector system may act on the target object virtually and/or in an abstract manner. The target object may itself be virtual or abstract as well. For example, an effector system may comprise a data processing embodiment for sorting data within a target comprising, for example, a database structure or software object. Additionally, effector system need not perform any action, process or the like that may be regarded as directly affecting the target. For example, in a cooperative engagement system comprising a software embodiment that predicts equity market performance, a target may comprise the purchase or sale of shares of stock as a function of reservations that are called out based on optimization of a valuation metric.

Sensor system 365 generally gathers information from any suitable source, using any number of sub-systems and/or devices to achieve any particular purpose. For example, sensor system 365 may comprise a camera to gather visual information, a microphone to collect auditory information, a motion sensor to detect movement, and/or the like. In an exemplary embodiment, sensor system 365 gathers information on a target, teammates and the environment. Sensor system 365 may gather information concerning the cooperative engagement system itself, such as positioning, status and diagnostic data. For example, sensor system 365 may comprise a global positioning system (GPS) suitably adapted to determine the position of the cooperative engagement system. The data collected by sensor system 365 may be provided to any sub-system and/or device. In a representative embodiment, for example, data collected by sensor system 365 may be provided to control system 350.

Communication interface 310 may be adapted in any suitable manner to communicate (e.g., transmit or receive) any type of data with any suitably configured sub-system or device. In a representative exemplary embodiment, communications interface 310 broadcasts the identity of the target reserved by the cooperative engagement system 300, as well as receiving reservations on target(s) 330 made by teammate (s) 320. It will be appreciated that communication system 310 may communicate data for any purpose. For example, communication system 310 may broadcast telemetry data collected by sensor sub-system 365 to aid tracking, as well as receive telemetry data broadcast by a teammate so that the position of the teammates 320 may be tracked by the cooperative engagement system 300.

Target pool 330 may comprise any suitable collection of objects, systems, devices, points in space, objectives and/or events. A target may comprise a physical object or system, such as an enemy aircraft. A target may also comprise, or be a representation for, any number of separate targets. For example, for a cooperative engagement system 300 adapted to detect and remove land mines, a target may comprise a point on the ground. In such an embodiment, the cooperative engagement system 300 may affect the targets by moving to the point on the ground, removing the earth above the mine, and disarming the mine.

Alternatively, conjunctively or sequentially, the target may comprise an event, virtual representation, data structure in a software program, and/or the like. For example, in a cooperative engagement system 300 implemented as a software process in a radar control system, a suitable target may include the event of detecting an enemy aircraft, where affecting the target comprises creating and populating a database record that includes position, speed and heading information for the enemy aircraft. Similarly, in a cooperative engagement system 300 implemented as a software process in a missile control system, a suitable target may include the database record describing the position information of an enemy aircraft, where affecting the target comprises the missile control system ordering a missile to be launched at the coordinates in the database record and then setting a flag in the database record indicating that a missile has been fired.

Teammates 320 may include any number of suitable objects, systems, devices, points in space, objectives and/or events. In an exemplary embodiment where the system for cooperative engagement 300 comprises, for example, an unmanned aerial vehicle (UAV), teammates 320 may include other UAVs. Each teammate may be suitably adapted to send and receive reservations on a target. A teammate may include any other suitable functionality, and need not have the same capabilities as that of any other teammate or agent.

A cooperative engagement system 300 in accordance with various aspects of the present invention selects a target to affect. In a representative and exemplary embodiment, control system 350 may select a target in any suitable manner, such as by performing a scoring process that assigns a weighted value to each target. For example, a scoring process according to various representative aspects of the present invention may assign values to a target according to: the distance from an engagement system agent and the target; the distance from the target to a protected asset; and the distance between the target and a teammate. Control system 350 may then select the target with the highest score from the scoring process. Control system 350 may use any suitable criteria, metrics and/or processes to select a particular target. For example, control system 350 may check to see if a target has been reserved by a teammate, and may remove a reserved target from consideration for subsequent selection. Alternatively, conjunctively or sequentially, control system 350 may consider the number of teammates reserving a target and, if the maximum number of reservations for the target has not been registered, reserve the target.

The cooperative engagement system 300 according to various aspects of the present invention may be configured to communicate reservation of selected target(s) to the teammates. Communications interface 310 may be suitably configured to broadcast the identification of the reserved target to other teammates. Teammates 320 may be configured to receive the reservation broadcast and register the selected target as reserved by a cooperative engagement teammate or other agent. In an exemplary embodiment of the present invention where each target may only be reserved by one cooperative engagement agent in teammate pool 320, other teammates or agents may be adapted to seek engagement of a different target from target pool 330.

Additionally, conjunctively or sequentially, the cooperative engagement system 300 in accordance with an exemplary embodiment of the present invention receives reservations on a target from a teammate. Communications interface 310 may be adapted to receive a reservation and communicate the reservation to control system 350, which includes the reservation in its processing to determine the suitability of remaining targets to reserve.

The cooperative engagement system 300 may perform any suitable function and process to affect a target in any suitable manner. In an exemplary embodiment, a cooperative engagement system 300 may comprise an un-manned aerial vehicle (UAV) having an actuation system comprising wings, a propeller, an engine and/or other devices that enable the UAV to fly. The UAV in this embodiment may also include an effector system 360 comprising an anti-aircraft missile. The cooperative engagement system 300 may affect a target comprising an enemy aircraft by using actuation system 355 to maneuver the cooperative engagement agent within range of the missile of effector system 360 and launch the missile at the target.

Figure 4:
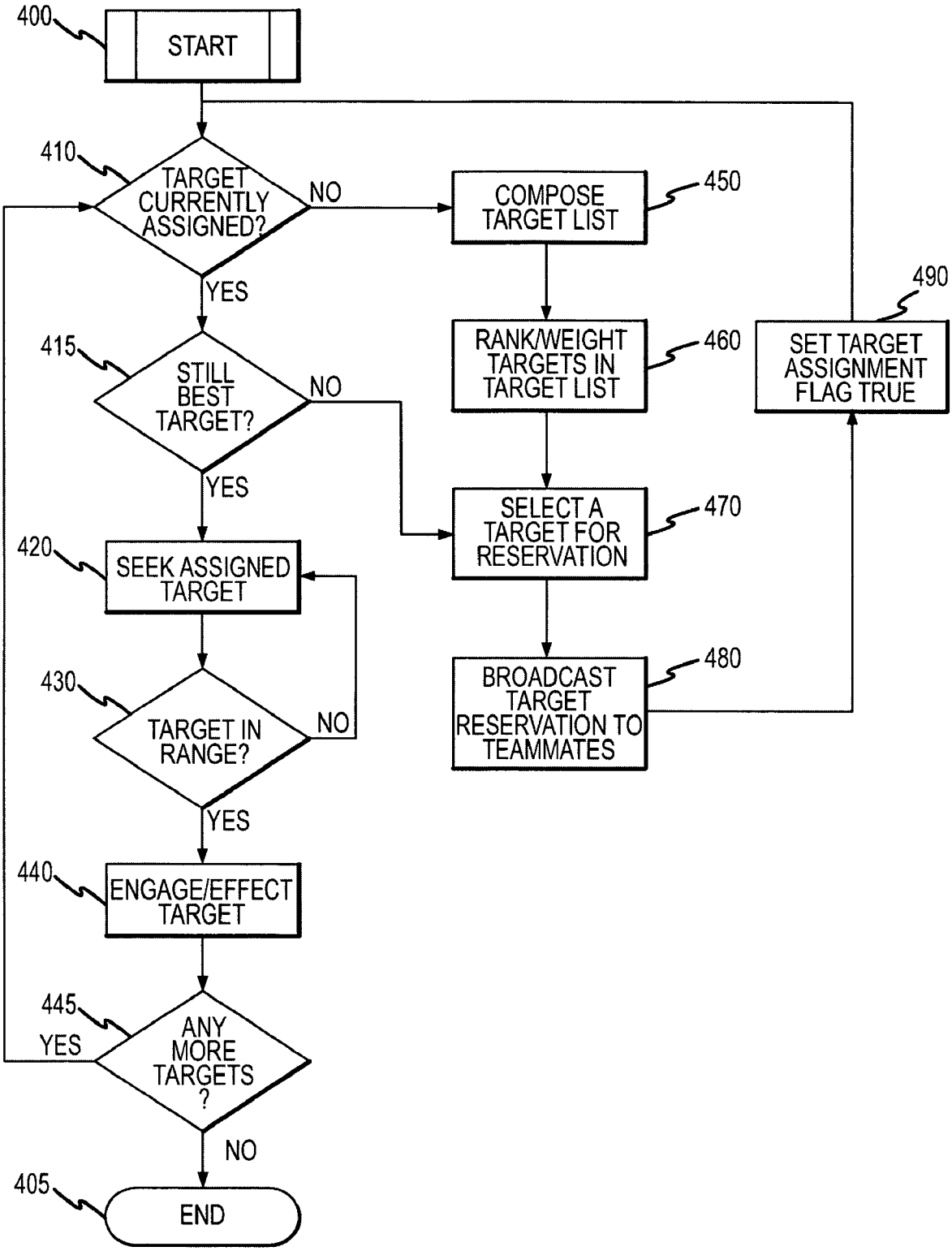
FIG. 4 representatively illustrates a process flow diagram of a cooperative engagement method in accordance with an exemplary embodiment of the present invention.

The cooperative engagement system 300 may perform any number of functions, processes and/or actions in any sequence. For example, in a cooperative engagement system in accordance with various aspects of the present invention, referring now to FIG. 4, the system may perform functions according to a priority scheme. For example, if the cooperative engagement system starts 400 with a reserved target 410 it will seek the target, and if the target is in range to be affected 430, affect 440 the target then, if there are no more targets 445, end 405 processing.

Optionally, if the cooperative engagement system does not have a current target reserved 410, the system may be adapted to check to see if a teammate is too close. If a teammate is too close, the cooperative engagement system may diverge from the neighboring teammate.

If the cooperative engagement system does not have a current target 410 and is not too close to a teammate, then the agent may proceed to acquire a target by, for example, composing a target list 450, ranking the targets 460, selecting a target 470 from the list, and broadcasting the target reservation 480, before setting a target assignment flag true 490 and then proceeding with further processing.

It should be noted that ranking and selection of a target may be performed even if a system already has a target reserved such that if a better target is found than the one reserved, the target reservation may be switched 415. Reservation may be constantly re-evaluated. The 415 determination involves a process substantially similar to that of 450, 460, but the currently assigned target may be given extra weight to prevent promiscuous switching between targets.

The disclosed detailed description of an exemplary application, namely a system and method for cooperative engagement, is provided as a specific enabling disclosure that may be generalized to any application of the disclosed system, device and method for cooperative engagement in accordance with various embodiments of the present invention.

Test Results

An exemplary embodiment of the present invention was tested in a simulation prototype for the agent-killer scenario describe vide supra. A comparison between the baseline greedy behavior-based approach and the hybrid technique of the invention that adds a tactical component was made.

A representative metric for the simulations was the distance that enemy swarms were allowed to approach a protected asset. If the enemies were allowed to penetrate a minimum required "keep-out distance", the protection force was deemed to fail; however, the agent agents were more successful the farther away they were able to keep the enemy swarms.

In one simulation, two agent agents (e.g., MAULLMs) were sent to protect a ship from three swarms of terrorists, seven Boghammars per swarm. The "keep-out distance" in this case was 8 nautical miles. When the simulation begins, the terrorists are 25 nautical miles away from the ship, traveling about 40 knots. The agent agent's velocity was 0.4 Mach with turn radii of 700 meters.

Each agent comprised 10 submunitions each. Since this problem is difficult for two agents, because 3 swarms, 7 boats each=21 targets, and two agents with 10 submunitions=22 weapons, after a MAULLM fires all its submunitions, the MAULLM itself was able to destroy one more target by flying into it and exploding.

With two agent agents, it is clear that the greedy algorithm cannot protect the ship. In the average simulation, terrorists approach to within 3.4 nautical miles of the ship. Sometimes the agents killed all terrorists before they penetrated the keep-out zone, most of the time the protection force failed. By contrast, when the hybrid algorithm was implemented with two agents, every simulation was a success for the protection force.

The usefulness of the present invention, as part of a decision support system, may be illustrated by describing the results of simulations with three agents. Even when using three agents, the greedy algorithm cannot always guarantee that terrorists will be kept outside the keep-out zone. However, with three agents, the hybrid algorithm of the present invention keeps the terrorists more than 14 nautical miles away from the ship, with less than 1 nautical mile variance. This is a very comfortable margin of safety.

Cruise missile systems such as tomahawk could add the disclosed system to their control systems to make them more collaborative. MAV and MALD-variants are designed to loiter in target areas. Most of these do not have submunitions, but the present invention may be adapted to perform equally well for dedicated missiles or more general-purpose recoverable UAVs with submunitions, like the ones used in MC2C, FCS, MALD and HURT. The present invention could also provide a discriminating function.

As mentioned above, the present invention does not only apply to air vehicles—unmanned ground vehicles may also benefit. Underwater vehicles that clear mines from a bay could also implement suitably adapted variations of the present invention.

In addition to its usefulness as a part of the onboard control system for an unmanned vehicle, the present invention may also provide part of a decision support system for a commander trying to decide how many missiles to fire. When the targets are first sighted, the commander can run a number of stochastic simulations of the behaviors of the missiles, increasing the number of missiles fired from 1 until the targets are prevented from reaching an acceptable "keep-out" range. These simulations could be structured to run very quickly using, for example, heuristic evaluations.

In the foregoing specification, the invention has been described with reference to specific exemplary embodiments; however, it will be appreciated that various modifications and changes may be made without departing from the scope of the present invention as set forth in the claims below. The specification and Figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above.

For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprising", "having", "including" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

We claim:

1. A method for distributive coordination among a plurality of autonomously controlled agents to affect at least one target, said method comprising the steps of:

composing a target list, said target list comprising a plurality of targets;

providing the target list to each of the plurality of autonomously controlled agents;

selecting a target for engagement, wherein each of the plurality of autonomously controlled agents is configured to:

independently rank the targets within the target list;

independently select its own target based on a set of target selection criteria and create a reservation on the selected target; and communicate the reservation of the selected target to at least one other of the plurality of autonomously controlled agents; and affecting the reserved target.

2. The method of claim 1, wherein each of the plurality of autonomously controlled agents comprises at least one of a sensor and a detector to locate at least one target of interest.

3. The method of claim 2, wherein at least one of said detector and said sensor is configured to locate at least one target that is closer than a maximum sensing range.

4. The method of claim 1, further comprising the step of providing location information to each of the plurality of autonomously controlled agents, said location information corresponding to at least one target located outside at least one of said detector and said sensor maximum sensing range.

5. The method of claim 1, wherein each of the plurality of autonomously controlled agents further comprises at least one onboard effector.

6. The method of claim 5, further comprising the step of employing said effector when a target is in range.

7. The method of claim 5, wherein said effector comprises at least one of a weapon and an agentic arm.

8. The method of claim 1, further comprising the step of receiving a reservation communication from one of the plurality of autonomously controlled agents.

9. The method of claim 1, wherein each of the plurality of autonomously controlled agents at least one of tracks a target and designates a target while deploying a weapon, and each of the plurality of autonomously controlled agents maintains said tracking and designation until the weapon hits the target.

10. The method of claim 1, wherein the target selection criteria includes at least one of a target reservation from a second autonomously controlled agent from the plurality of autonomously controlled agents and a target valuation based on at least one of a scoring function and a prioritization scheme.

11. The method of claim 10, wherein said scoring function comprises a linear combination of a plurality of metrics.

12. The method of claim 11, wherein said metrics comprise a weighting function configured to at least one of increase and decrease said metric's contribution to the scoring function.

13. The method of claim 11, wherein a metric to be minimized is the distance between the agent and the target.

14. The method of claim 11, wherein a metric to be minimized is the distance between the target and an engagement goal of the target.

15. The method of claim 11, wherein a metric to be maximized is the distance from a target to the nearest reserved target.

16. The method of claim 11, wherein a first autonomously controlled agent predicts the scores the second autonomously controlled agent will obtain for each target, and said first autonomously controlled agent chooses a target whose predicted score of said second autonomously controlled agent is not the highest of said scores.

17. The method of claim 11, wherein at least one of:

each of the plurality of autonomously controlled agent has a range corresponding to a maximum firing range of a weapon;

each of the plurality of autonomously controlled agent is configured to reserve at least one of a single target at a time and at least a plurality of targets at once;

each of the plurality of autonomously controlled agent affects said target when said target is in range;

each of the plurality of autonomously controlled agent affects said target when any valid target enters a predetermined perimeter; and each of the plurality of autonomously controlled agent releases its reservation.

18. The method of claim 1, further comprising the step of providing an actuation system, said actuation system response to a control system that is configured to maneuver said agent.

19. The method of claim 1, further comprising the step of providing a communications interface, said communications interface configured to communication at least one of reservation and positioning data.

20. A method for distributive cooperative engagement of a target between a first autonomously controlled agent and a second autonomously controlled agent, said method comprising the steps of:

providing each of the first and second autonomously controlled agents with a sensor system adapted to collect targeting information;

providing each of the first and second autonomously controlled agents with a control system in communication with said sensor system, wherein said control system is adapted to create a target reservation based on at least one of said targeting information and a set of at least one of targeting and engagement criteria;

providing each of the first and second autonomously controlled agents with a communications interface in communication with said control system, wherein said communications interface is adapted to communicate the target reservation from the first autonomously controlled agent to the second autonomously controlled agent; and providing each of the first and second autonomously controlled agents with an effector system in communication with said control system, wherein said effector system is adapted to affect a target.

21. The method of claim 20, further comprising the step of providing an actuation system to each of the first and second autonomously controlled agents, said actuation system responsive to the control system and adapted to maneuver each of the first and second autonomously controlled agents.

* * * * *